US005684268A

United States Patent [19]

Lopata

[11] Patent Number: 5,684,268

[45] Date of Patent: Nov. 4, 1997

[54] LEAD-FREE PRIMER MIX

[75] Inventor: Frances G. Lopata, Little Rock, Ark.

[73] Assignee: Remington Arms Company, Inc., Madison, N.C.

[21] Appl. No.: 536,614

[22] Filed: Sep. 29, 1995

[51] Int. Cl.[6] ..... C04B 33/10

[52] U.S. Cl. ..... 149/39; 149/38; 149/41; 149/68

[58] Field of Search ..... 149/38, 39, 68, 149/41

[56] References Cited

U.S. PATENT DOCUMENTS

| | | | |
|---|---|---|---|
| 4,246,052 | 1/1981 | Hagel et al. | 149/23 |
| 4,363,679 | 12/1982 | Hagel et al. | 149/38 |
| 4,566,921 | 1/1986 | Duguet | 149/22 |
| 4,963,201 | 10/1990 | Bjerke et al. | 149/2 |
| 5,167,736 | 12/1992 | Mei et al. | 149/22 |
| 5,216,199 | 6/1993 | Bjerke et al. | 102/471 |
| 5,353,702 | 10/1994 | Duguet | 102/290 |
| 5,388,519 | 2/1995 | Guindon et al. | 102/292 |
| 5,417,160 | 5/1995 | Mei et al. | 102/289 |
| 5,567,252 | 10/1996 | Mei et al. | 149/39 |

*Primary Examiner*—Edward A. Miller
*Attorney, Agent, or Firm*—Huntley & Associates

[57] ABSTRACT

A lead-free primer mix based on diazodinitrophenol, tetrazene, nitrocellulose, barium nitrate and at least one of PETN, aluminum and antimony sulfide exhibits performance characteristics comparable to lead styphnate compositions.

6 Claims, No Drawings

LEAD-FREE PRIMER MIX

BACKGROUND OF THE INVENTION

Percussion primers are used in firearm ammunition to provide a link between the firing pin and the propellant charge within the ammunition. Lead styphnate has been used for many years as a key ingredient in such primer mixtures. However, continuing effort has been directed to the development of explosive mixtures that would provide excellent performance as primers but without the lead compounds previously used.

SUMMARY OF THE INVENTION

The present invention provides a primer mixture that exhibits excellent explosive characteristics, but without the lead compounds previously used in such mixtures.

Specifically, the instant invention provides a primer mix consisting essentially of:

about from 27 to 35% by weight diazodinitrophenol;

about from 4 to 11% by weight of tetrazene;

at least about 4% by weight of at least one compound selected from PETN, aluminum, antimony sulfide;

about from 5 to 11% by weight double-based nitrocellulose; and about from 40 to 55% by weight barium nitrate.

DETAILED DESCRIPTION OF THE INVENTION

The present invention is based on the discovery of a mixture of the indicated components in the specified quantities, which match the energetic performance of a product based on lead styphnate currently used commercially in the manufacture of munition primers.

The compositions contain about from 27 to 35% diazodinitrophenol, which serves the primary explosive in the present compositions. Less than about 27 weight percent of this material will not provide good shock propagation, while concentrations of this ingredient at greater than 35 weight percent will result in a shock velocity that is too high for customary use.

The composition further contains about from 4 to 11 weight percent tetrazene. This compound is also known as tetracene, tetrazolyl guanyltetrazene hydrate or tetrazene-1-carboxamidine-4-(1-H-tetrazol-5-yl) monohydrate. This is a second explosive component in the present mixtures. Less than about 4% by weight in the composition is difficult to incorporate with reliability using typical manufacturing techniques, while greater than about 11% increases the shock pressure beyond normally acceptable limits.

The compositions further comprise about from 5 to 11 weight percent nitrocellulose, and preferably doubled-based nitrocellulose, as a further explosive component. Concentrations of nitrocellulose within this range provide effective pressure regulation of the formulation.

The compositions further contain at least about 4% by weight of at least one composition selected from aluminum, antimony sulfide and pentaerythritol tetranitrate (PETN). The balance of these three components can be adjusted to provide the desired shock or detonation velocity, detonation pressure and output temperature. In general, up to about 5% by weight PETN, up to about 9% by weight aluminum and up to about 11% by weight antimony sulfide can be used. When antimony sulfide is used alone, about from 8 to 11 weight percent is preferred. Another desirable combination is substantially equal concentrations of PETN and aluminum, desirably without the presence of antimony sulfide. In this case, about 5% each of PETN and aluminum have been found to be particularly satisfactory.

Barium nitrate is present in an amount of about from 40 to 55% by weight. The function of the barium nitrate is as an oxidizer. The primer mix will generally not properly ignite at concentrations of less than about 40% by weight, while concentrations of the barium nitrate greater than about 55 weight percent will not exhibit satisfactory explosive propagation.

As will be recognized the those skilled in the art, the formulations will generally also contain up to about 2% binder to minimize dusting. Typically, about from 0.5 to 1.5% by weight is used. The particular binder used will be selected for maximum compatibility with the explosive formulation prepared. Binders which can be used can be selected from a variety of gums, such as gum arabics, and particularly gum arabic (acacia), as well as polyvinyl alcohol with guar gum. However, gum arabic has been found to be particularly satisfactory.

The indicated components can be combined by the use of standard low shear mixers, using customary techniques for blending explosives. With these techniques, the explosive components are generally blended first, followed by the fuels, and finally the oxidizer components.

The compositions of the present invention remarkably match the energetics of currently manufactured formulations based on lead styphnate, as will be more fully illustrated by the following examples and comparative example, in which parts and percentages are by weight.

EXAMPLES 1–3 AND COMPARATIVE EXAMPLE A

A primer mixture was prepared using a low shear mixer by combining diazodinitrophenol, tetrazene, nitrocellulose and PETN in the indicated quantities, followed by the addition of aluminum, antimony sulfide and binder, and finally barium nitrate. The concentrations used are indicated in Table I.

The performance characteristics were calculated for the formulations of Examples 1, 2 and 3 and a lead styphnate mix currently used commercially for primer production and identified in Table II as Comparative Example A.

The mixtures were tested for performance, and the test results are also summarized in Table II. As can be seen from that table, the compositions of the present invention exhibit excellent performance characteristics opposite the prior lead styphnate composition of Comparative Example A.

TABLE I

| EXAMPLE | 1 | 2 | 3 |
|---|---|---|---|
| diazodinitrophenol | 28% | 30% | 35% |
| tetrazene | 5% | 10% | 10% |
| PETN | — | 5% | 5% |
| aluminum | — | 5% | 5% |
| antimony sulfide | 11% | — | — |
| nitrocellulose (doubled-based) | 6% | 10% | 5% |
| barium nitrate | 50% | 40% | 40% |
| binder | 0.5% | 0.5% | 0.5% |

TABLE II

| EXAMPLE | 1 | 2 | 3 | A |
|---|---|---|---|---|
| Calculated values for: | | | | |
| Shock velocity (m/s) | 6062 | 6742 | 6730 | 5362 |
| Detonation pressure (atm) | 173300 | 203110 | 200120 | 173300 |
| Reaction temperture (K.) | 1372 | 2557 | 2462 | 2995 |
| Reaction enthalpy (cal/g) | 1570 | 2089 | 2061 | 1256 |
| Reaction entropy (cal/g) | 173 | 252 | 245 | 142 |
| Ballistic testing results: | | | | |
| Small pistol, die test, 2 oz ball drop height (inches for 50% fire) | 3.24" | 3.68" | 3.82" | 3.96" |
| Loaded in 357 MAG 125 gr SJHP: | | | | |
| Velocity, ambient (fps)** | 1839 | 1837 | 1835 | 1870 |
| Pressure, ambient (psi)*** | 30000 | 30800 | 30100 | 31900 |
| Velocity, +150 F. (fps) | 1898 | 1904 | 1900 | 1921 |
| Pressure, +150 F. (psi) | 31500 | 33300 | 33200 | 34800 |
| Velocity, −20 F. (fps) | 1731 | 1741 | 1745 | 1743 |
| Pressure, −20 F. (psi) | 26300 | 26700 | 28800 | 26400 |

**Specification: 1875 fps +/−35 fps
***Specification: 35000 psi maximum

I claim:

1. A primer mix consisting essentially of:

about from 27 to 35% by weight diazodinitrophenol;

about from 4 to 11% by weight of tetrazene;

at least about 4% by weight of at least one compound selected from PETN, aluminum, antimony sulfide;

about from 5 to 11% by weight double-based nitrocellulose; and about from 40 to 55% by weight barium nitrate.

2. A primer mix of claim 1 wherein the antimony sulfide is present in an amount of about from 8 to 11% by weight.

3. A primer mix of claim 1 having PETN and aluminum.

4. A primer mix of claim 3 wherein PETN and aluminum are each present in an amount of about 5% by weight.

5. A primer mix of claim 1 having at least about 30% diazodinitrophenol.

6. A primer mix of claim 1 having up to about 2% binder.

* * * * *